US010675679B2

(12) United States Patent
Cooper

(10) Patent No.: US 10,675,679 B2
(45) **Date of Patent: *Jun. 9, 2020**

(54) TRANSFER PUMP LAUNDER SYSTEM

(71) Applicant: Molten Metal Equipment Innovations, LLC, Middlefield, OH (US)

(72) Inventor: Paul V. Cooper, Chesterland, OH (US)

(73) Assignee: Molten Metal Equipment Innovations, LLC, Middlefield, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/415,271

(22) Filed: May 17, 2019

(65) Prior Publication Data

US 2019/0270134 A1 Sep. 5, 2019

Related U.S. Application Data

(63) Continuation of application No. 16/030,547, filed on Jul. 9, 2018, now Pat. No. 10,307,821, which is a continuation of application No. 13/841,938, filed on Mar. 15, 2013, now Pat. No. 10,052,688.

(51) Int. Cl.

| | |
|---|---|
| ***B22D 45/00*** | (2006.01) |
| ***F04D 29/60*** | (2006.01) |
| ***F04D 7/06*** | (2006.01) |

(52) U.S. Cl.
CPC ..... *B22D 45/00* (2013.01); *F04D 7/065* (2013.01); *F04D 29/607* (2013.01); *Y10T 137/85978* (2015.04)

(58) Field of Classification Search
CPC ..... F04D 7/06; F04D 7/065; F04D 29/607; F04D 29/605; B22D 45/00
See application file for complete search history.

(56) References Cited

U.S. PATENT DOCUMENTS

| | | | | |
|---|---|---|---|---|
| 3,048,384 A * | 8/1962 | Sweeney | B22D 39/00 415/88 |
| 5,944,496 A * | 8/1999 | Cooper | F04D 7/065 266/235 |
| 2011/0303706 A1* | 12/2011 | Cooper | C22B 9/00 222/594 |

* cited by examiner

*Primary Examiner* — Bryan M Lettman
(74) *Attorney, Agent, or Firm* — Snell & Wilmer L.L.P.

(57) ABSTRACT

A transfer pump has a pump base with a pump chamber and an output port in the top surface of the pump base. A riser tube extends from the outlet and terminates at a launder having a first end juxtaposed the riser tube, an open top, and a bottom having a launder opening. This structure enables the movement of molten metal out of a vessel with relatively little turbulence.

18 Claims, 6 Drawing Sheets

TRANSFER PUMP LAUNDER SYSTEM

CROSS REFERENCE TO RELATED APPLICATIONS

This application is a continuation of, and claims priority to U.S. patent application Ser. No. 16/030,547, filed on Jul. 9, 2018, by Paul V. Cooper, which is a continuation of, and claims priority to U.S. patent application Ser. No. 13/841,938, filed on Mar. 15, 2013 (Now U.S. Pat. No. 10,052,688), by Paul V. Cooper the disclosures of which are incorporated herein by reference in their entirety for all purposes.

FIELD OF THE INVENTION

The present invention relates generally to transfer pumps and transfer pumps that generate a small amount of turbulence by having a riser tube that terminates at a launder above the molten metal bath in which the pump rate is submerged.

BACKGROUND

As used herein, the term "molten metal" means any metal or combination of metals in liquid form, such as aluminum, copper, iron, zinc and alloys thereof. The term "gas" means any gas or combination of gases, including argon, nitrogen, chlorine, fluorine, freon, and helium, that are released into molten metal.

Known molten-metal pumps include a pump base (also called a housing or casing), one or more inlets (an inlet being an opening in the housing to allow molten metal to enter a pump chamber), a pump chamber, which is an open area formed within the housing, and a discharge, which is a channel or conduit of any structure or type communicating with the pump chamber (in an axial pump the chamber and discharge may be the same structure or different areas of the same structure) leading from the pump chamber to an outlet, which is an opening formed in the exterior of the housing through which molten metal exits the casing. An impeller, also called a rotor, is mounted in the pump chamber and is connected to a drive system. The drive system is typically an impeller shaft connected to one end of a drive shaft, the other end of the drive shaft being connected to a motor. Often, the impeller shaft is comprised of graphite, the motor shaft is comprised of steel, and the two are connected by a coupling. As the motor turns the drive shaft, the drive shaft turns the impeller and the impeller pushes molten metal out of the pump chamber, through the discharge, out of the outlet and into the molten metal bath. Most molten metal pumps are gravity fed, wherein gravity forces molten metal through the inlet and into the pump chamber as the impeller pushes molten metal out of the pump chamber.

A number of submersible pumps used to pump molten metal (referred to herein as molten metal pumps) are known in the art. For example, U.S. Pat. No. 2,948,524 to Sweeney et al., U.S. Pat. No. 4,169,584 to Mangalick, U.S. Pat. No. 5,203,681 to Cooper, U.S. Pat. No. 6,093,000 to Cooper and U.S. Pat. No. 6,123,523 to Cooper, and U.S. Pat. No. 6,303,074 to Cooper, all disclose molten metal pumps. The disclosures of the patents to Cooper noted above are incorporated herein by reference. The term submersible means that when the pump is in use, its base is at least partially submerged in a bath of molten metal.

Three basic types of pumps for pumping molten metal, such as molten aluminum, are utilized: circulation pumps, transfer pumps and gas-release pumps. Circulation pumps are used to circulate the molten metal within a bath, thereby generally equalizing the temperature of the molten metal. Most often, circulation pumps are used in a reverbatory furnace having an external well. The well is usually an extension of the charging well where scrap metal is charged (i.e., added).

Transfer pumps are generally used to transfer molten metal from the external well of a reverbatory furnace to a different location such as a ladle or another furnace.

Gas-release pumps, such as gas-injection pumps, circulate molten metal while introducing a gas into the molten metal. In the purification of molten metals, particularly aluminum, it is frequently desired to remove dissolved gases such as hydrogen, or dissolved metals, such as magnesium. As is known by those skilled in the art, the removing of dissolved gas is known as "degassing" while the removal of magnesium is known as "demagging." Gas-release pumps may be used for either of these purposes or for any other application for which it is desirable to introduce gas into molten metal.

Gas-release pumps generally include a gas-transfer conduit having a first end that is connected to a gas source and a second end submerged in the molten metal bath. Gas is introduced into the first end and is released from the second end into the molten metal. The gas may be released downstream of the pump chamber into either the pump discharge or a metal-transfer conduit extending from the discharge, or into a stream of molten metal exiting either the discharge or the metal-transfer conduit. Alternatively, gas may be released into the pump chamber or upstream of the pump chamber at a position where molten metal enters the pump chamber.

Generally, a degasser (also called a rotary degasser) includes (1) an impeller shaft having a first end, a second end and a passage for transferring gas, (2) an impeller, and (3) a drive source for rotating the impeller shaft and the impeller. The first end of the impeller shaft is connected to the drive source and to a gas source and the second end is connected to the connector of the impeller. Examples of rotary degassers are disclosed in U.S. Pat. No. 4,898,367 entitled "Dispersing Gas Into Molten Metal," U.S. Pat. No. 5,678,807 entitled "Rotary Degassers," and U.S. Pat. No. 6,689,310 to Cooper entitled "Molten Metal Degassing Device and Impellers Therefore," filed May 12, 2000, the respective disclosures of which are incorporated herein by reference.

The materials forming the components that contact the molten metal bath should remain relatively stable in the bath. Structural refractory materials, such as graphite or ceramics, that are resistant to disintegration by corrosive attack from the molten metal may be used. As used herein "ceramics" or "ceramic" refers to any oxidized metal (including silicon) or carbon-based material, excluding graphite, capable of being used in the environment of a molten metal bath. "Graphite" means any type of graphite, whether or not chemically treated. Graphite is particularly suitable for being formed into pump components because it is (a) soft and relatively easy to machine, (b) not as brittle as ceramics and less prone to breakage, and (c) less expensive than ceramics.

Generally a scrap melter includes an impeller affixed to an end of a drive shaft, and a drive source attached to the other end of the drive shaft for rotating the shaft and the impeller. The movement of the impeller draws molten metal and scrap metal downward into the molten metal bath in order to melt the scrap. A circulation pump is preferably used in conjunction with the scrap melter to circulate the molten metal in order to maintain a relatively constant temperature within the molten metal. Scrap melters are disclosed in U.S. Pat.

No. 4,598,899 to Cooper, U.S. patent application Ser. No. 09/649,190 to Cooper, filed Aug. 28, 2000, and U.S. Pat. No. 4,930,986 to Cooper, the respective disclosures of which are incorporated herein by reference.

Molten metal transfer pumps have been used, among other things, to transfer molten aluminum from a well to a ladle or launder, wherein the launder normally directs the molten aluminum into a ladle or into molds where it is cast into solid, usable pieces, such as ingots. The launder is essentially a trough, channel or conduit outside of the reverbatory furnace. A ladle is a large vessel into which molten metal is poured from the furnace. After molten metal is placed into the ladle, the ladle is transported from the furnace area to another part of the facility where the molten metal inside the ladle is poured into other vessels, such as smaller holders or molds. A ladle is typically filled in two ways. First, the ladle may be filled by utilizing a transfer pump positioned in the furnace to pump molten metal out of the furnace, through a metal-transfer conduit and over the furnace wall, into the ladle or other vessel or structure. Second, the ladle may be filled by transferring molten metal from a hole (called a tap-out hole) located at or near the bottom of the furnace and into the ladle. The tap-out hole is typically a tapered hole or opening, usually about 1"-4" in diameter, that receives a tapered plug called a "tap-out plug." The plug is removed from the tap-out hole to allow molten metal to drain from the furnace, and is inserted into the tap-out hole to stop the flow of molten metal out of the furnace.

There are problems with each of these known methods. Referring to filling a ladle utilizing a transfer pump, there is splashing (or turbulence) of the molten metal exiting the transfer pump and entering the ladle. This turbulence causes the molten metal to interact more with the air than would a smooth flow of molten metal pouring into the ladle. The interaction with the air leads to the formation of dross within the ladle and splashing also creates a safety hazard because persons working near the ladle could be hit with molten metal. Further, there are problems inherent with the use of most transfer pumps. For example, the transfer pump can develop a blockage in the riser, which is an extension of the pump discharge that extends out of the molten metal bath in order to pump molten metal from one structure into another. The blockage blocks the flow of molten metal through the pump and essentially causes a failure of the system. When such a blockage occurs the transfer pump must be removed from the furnace and the riser tube must be removed from the transfer pump and replaced. This causes hours of expensive downtime. A transfer pump also has associated piping attached to the riser to direct molten metal from the vessel containing the transfer pump into another vessel or structure. The piping is typically made of steel with an internal liner. The piping can be between 1 and 50 feet in length or even longer. The molten metal in the piping can also solidify causing failure of the system and downtime associated with replacing the piping.

If a tap-out hole is used to drain molten metal from a furnace a depression may be formed in the factory floor or other surface on which the furnace rests, and the ladle can preferably be positioned in the depression so it is lower than the tap-out hole, or the furnace may be elevated above the floor so the tap-out hole is above the ladle. Either method can be used to enable molten metal to flow using gravity from the tap-out hole into the ladle.

Use of a tap-out hole at the bottom of a furnace can lead to problems. First, when the tap-out plug is removed molten metal can splash or splatter causing a safety problem. This is particularly true if the level of molten metal in the furnace is relatively high which leads to a relatively high pressure pushing molten metal out of the tap-out hole. There is also a safety problem when the tap-out plug is reinserted into the tap-out hole because molten metal can splatter or splash onto personnel during this process. Further, after the tap-out hole is plugged, it can still leak. The leak may ultimately cause a fire, lead to physical harm of a person and/or the loss of a large amount of molten metal from the furnace that must then be cleaned up, or the leak and subsequent solidifying of the molten metal may lead to loss of the entire furnace.

Another problem with tap-out holes is that the molten metal at the bottom of the furnace can harden if not properly circulated thereby blocking the tap-out hole or the tap-out hole can be blocked by a piece of dross in the molten metal.

A launder may be used to pass molten metal from the furnace and into a ladle and/or into molds, such as molds for making ingots of cast aluminum. Several die cast machines, robots, and/or human workers may draw molten metal from the launder through openings (sometimes called plug taps). The launder may be of any dimension or shape. For example, it may be one to four feet in length, or as long as 100 feet in length. The launder is usually sloped gently, for example, it may be sloped gently upward at a slope of approximately ⅛ inch per each ten feet in length, in order to use gravity to direct the flow of molten metal out of the launder, either towards or away from the furnace, to drain all or part of the molten metal from the launder once the pump supplying molten metal to the launder is shut off. In use, a typical launder includes molten aluminum at a depth of approximately 1-10."

A need exists for a standard-style transfer pump, which has pump base submerged in a molten metal bath, a discharge via the top surface of the pump base, and a metal-transfer conduit (also referred to herein as a riser tube) that can transfer molten metal out of a vessel while reducing turbulence and draft formation. The disclosures of U.S. Pat. Nos. 6,345,964, 5,203,681, and U.S. patent application Ser. No. 13/797,616, filed on Mar. 12, 2013, that are not inconsistent with the disclosure herein are incorporated by reference.

SUMMARY OF THE INVENTION

The present invention relates to a transfer pump used to transfer molten metal out of a vessel. The pump is a standard transfer pump base. The riser tube, or metal transfer conduit, terminates at a launder above the molten metal bath in which the pump base is submerged in order to provide a relatively smooth, non-turbulent flow of molten metal.

DETAILED DESCRIPTION OF A PREFERRED EMBODIMENT

Figure 1:
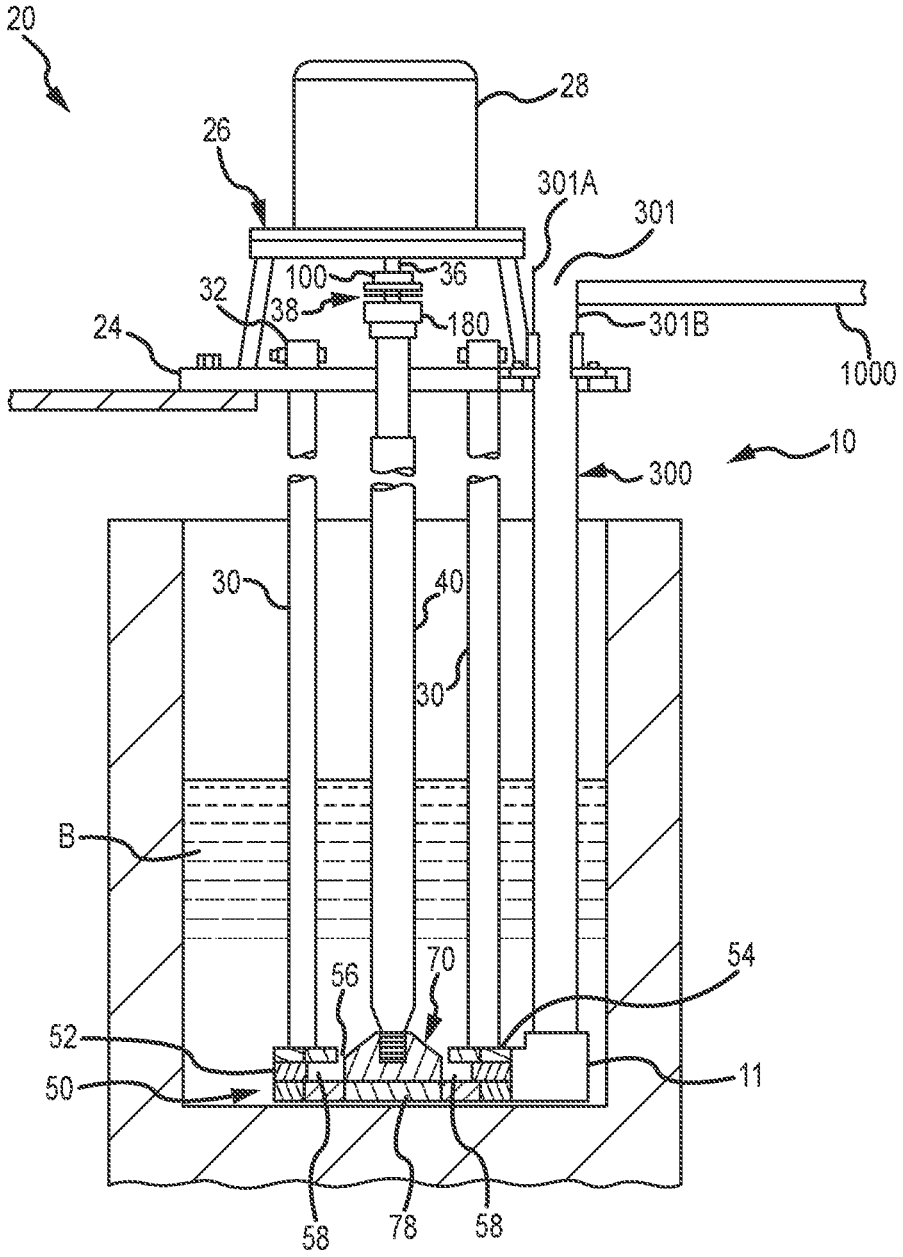
FIG. 1 is a front, partial cross-sectional view of a transfer pump according to an aspect of the invention.

Referring now to the figures, where the purpose is for describing a preferred embodiment of the invention and not for limiting same, FIG. 1 shows a pumping device 10 submerged in a metallic bath B. Device 10 has a superstructure 20 and a base 50. Superstructure 20 is positioned outside of bath B when device 10 is operating and generally comprises a mounting plate 24 that supports a motor mount 26. A motor 28 is mounted to mount 26. Motor 28 is preferably electric or pneumatic although, as used herein, the term motor refers to any device capable of driving a rotor 70.

Superstructure 20 is connected to base 50 by one or more support posts 30. Preferably posts 30 extend through openings (not shown) in plate 24 and are secured by post clamps 32, which are preferably bolted to the top surface (preferred) or lower surface of plate 24.

A motor drive shaft 36 extends from motor 28. A coupling 38 has a first coupling member 100, attached to drive shaft 36, and a second coupling member 180, attached to a rotor shaft 40. Motor drive shaft 36 drives coupling 38 which, in turn, drives rotor shaft 40. Preferably neither coupling 38 nor shaft 40 have any connecting threads, although any suitable coupling may be used.

Figure 7:
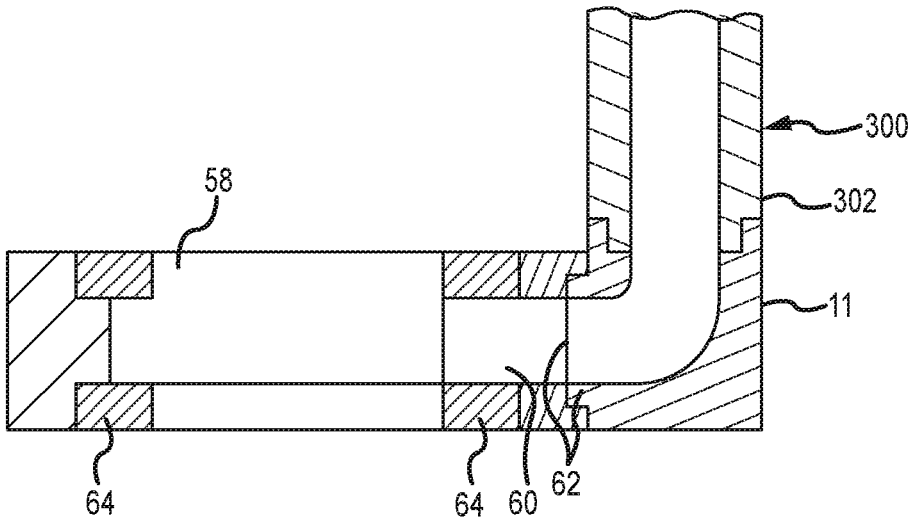
FIG. 7 is a partial, cross-sectional view showing the preferred pump base and lower portion of the riser tube of FIGS. 1-4.

Base 50 is preferably formed from graphite or other suitable material. Base 50 includes a top surface 54 and an input port 56, preferably formed in top surface 54. A pump chamber 58, which is in communication with port 56, is a cavity formed within housing 50. A discharge 60, shown in FIG. 7, is preferably formed tangentially with, and is in fluid communication with, pump chamber 58. Discharge 60 leads to an output port 62, shown in FIG. 7 as being formed in a side surface of housing 50. A wear ring or bearing ring 64 is preferably made of ceramic and is cemented to the lower edge of chamber 58. Device 10 incorporates a metal-transfer conduit, or riser tube, 300 connected to output port 62. Conduit 300 is normally used in conjunction with an elbow to transfer the pumped molten metal into another molten metal bath, but as described herein instead connects to a launder 1000.

As shown in FIG. 1, rotor 70 is attached to and driven by shaft 40. Rotor 70 is preferably placed centrally within chamber 58, and may be of any suitable design. Rotor 70 is preferably imperforate, being formed of solid graphite or graphite and ceramic.

Rotor 70 further includes a connective portion 74, which is preferably a threaded bore, but can be any structure capable of drivingly engaging rotor shaft 40. A flow blocking plate 78 is preferably formed of ceramic and is cemented to the base of rotor 70. Plate 78 rides against bearing ring 64 and blocks molten metal from entering or exiting through the bottom of chamber 58. Alternatively, the bearing ring could be eliminated, in which case there would be a second input port.

Coupling 38 generally comprises a first coupling member 100, a disk 150 and a second coupling member 180. First coupling member 100 is preferably formed of metal, and most preferably steel, and is dimensioned to receive an end of motor drive shaft 36.

Second coupling member 180 is designed to receive and drive rotor shaft 40. Member 180 is preferably formed of metal such as steel or aluminum although other materials may be used.

As shown, pumping device 10 is a transfer pump, in which case it will include transfer pump base 50 as shown, or any other suitable base. As previously described, and as shown in FIG. 1, base 50 includes an upper surface 54 and a discharge 60 leading to an output port 62, which is formed in a side of base 50 (as used herein, the term discharge refers to the passageway leading from the pump chamber to the output port, and the output port is the actual opening in the exterior surface of the pump base). In this embodiment, an extension piece 11 is attached to output port 62 and defines a passageway formed as an elbow so as to direct the flow of the pumped molten metal upward. A metal-transfer conduit 300 is connected to extension member 11 and can be secured by being cemented thereto.

The invention does not include a U-shape at the distal, or top, end of the riser tube 300 so that molten metal is released from the end and splashes into another structure or vessel. Instead molten metal is pushed to the top of the riser tube and enters a launder 1000. This avoids splashing and dross formation.

FIG. 1 shows an embodiment where riser tube 300 terminates at distal end 301 and distal end 301 has a raised back portion 301A and a lower front portion 301B that is inside the launder 1000. Riser tube 300 is supported by the superstructure 20. A top view of such a structure is shown in FIG. 5 with the arrow denoting the flow of molten metal through the launder 1000. This same structure of the distal end 301 could be entirely inside of the launder 1000, and such a structure is shown in FIG. 6 (and FIGS. 3-4) with the arrow again denoting the fluid flow direction.

Figure 2:
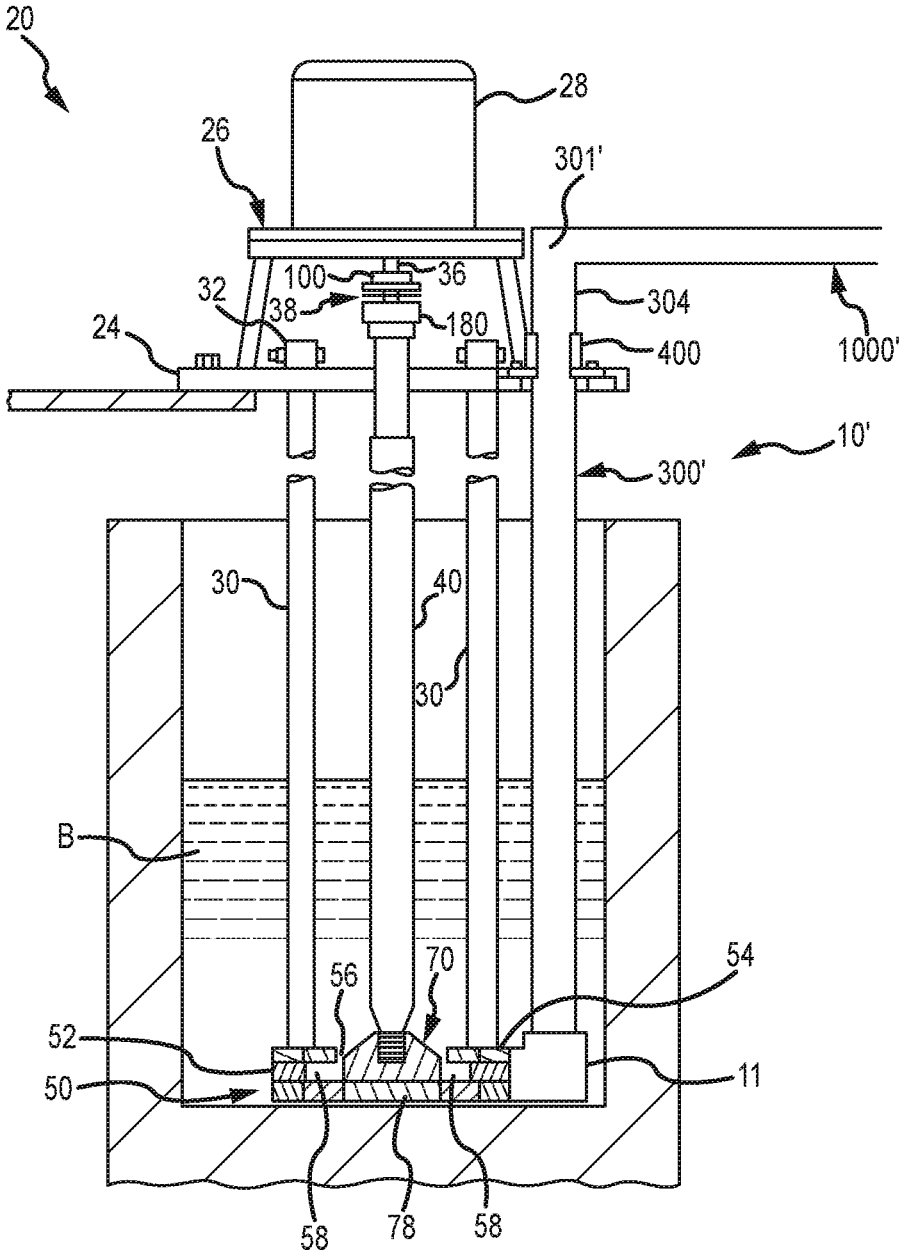
FIG. 2 is a front, partial cross-sectional view of a transfer pump according to an aspect of the invention.

FIG. 2 shows a riser tube 300' that is integrally connected with a launder 1000'.

Figure 3:
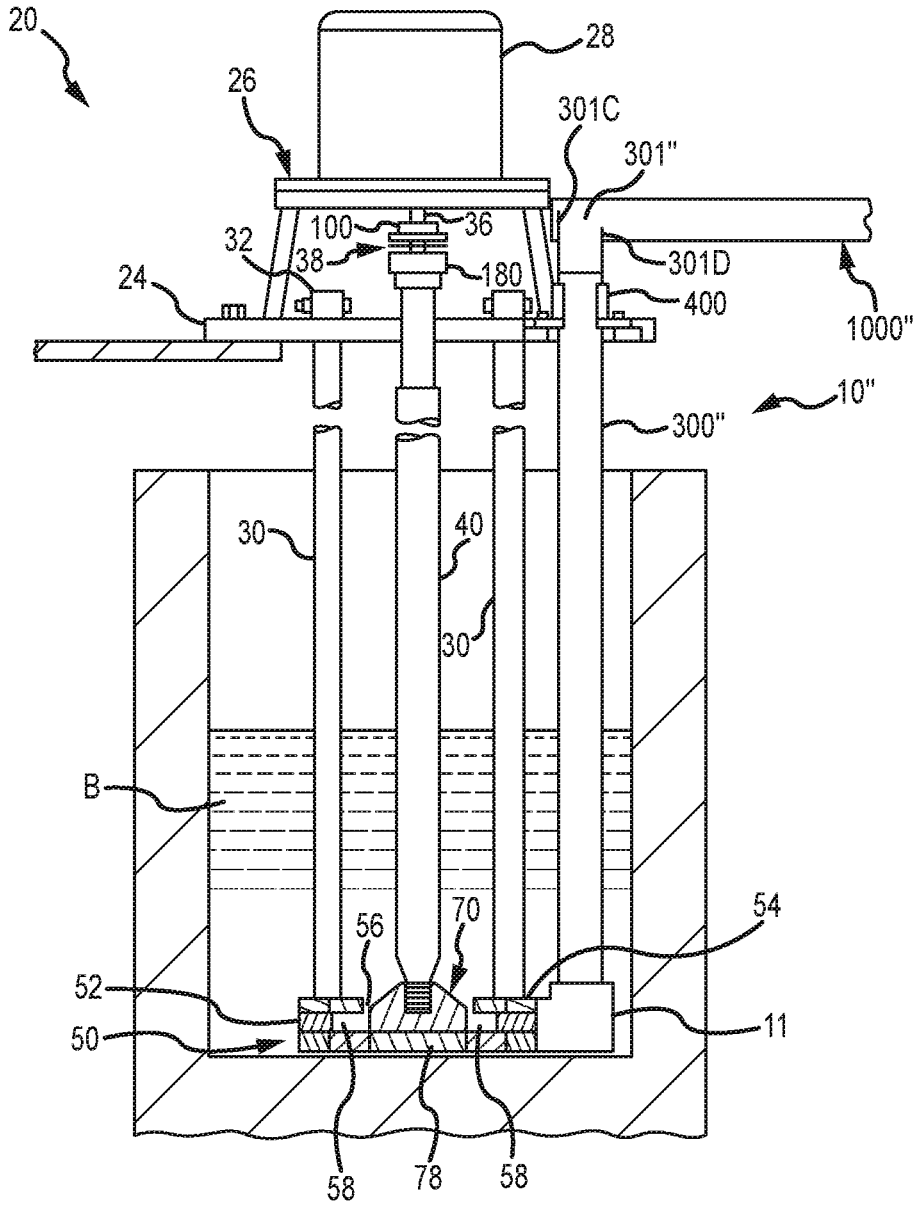
FIG. 3 is a front, partial cross-sectional view of a transfer pump according to an aspect of the invention.
Figure 6:
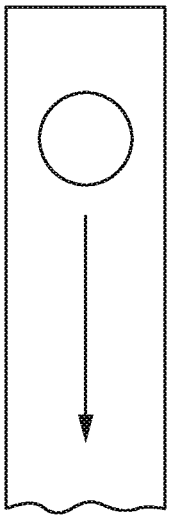
FIG. 6 is a top view of the riser tube/launder configuration of FIG. 3 or FIG. 4 (with the top wall of launder 1000" or 2000, respectively, removed).

FIG. 3 shows a side view of a riser tube 300" having a distal end 300" that is entirely inside of riser tube 1000", and a top view of such a structure is shown in FIG. 6. End 301" has a raised back portion 301A and a lower front portion 301B, so molten metal is moved in the direction indicated by the arrow in FIG. 6.

Figure 4:
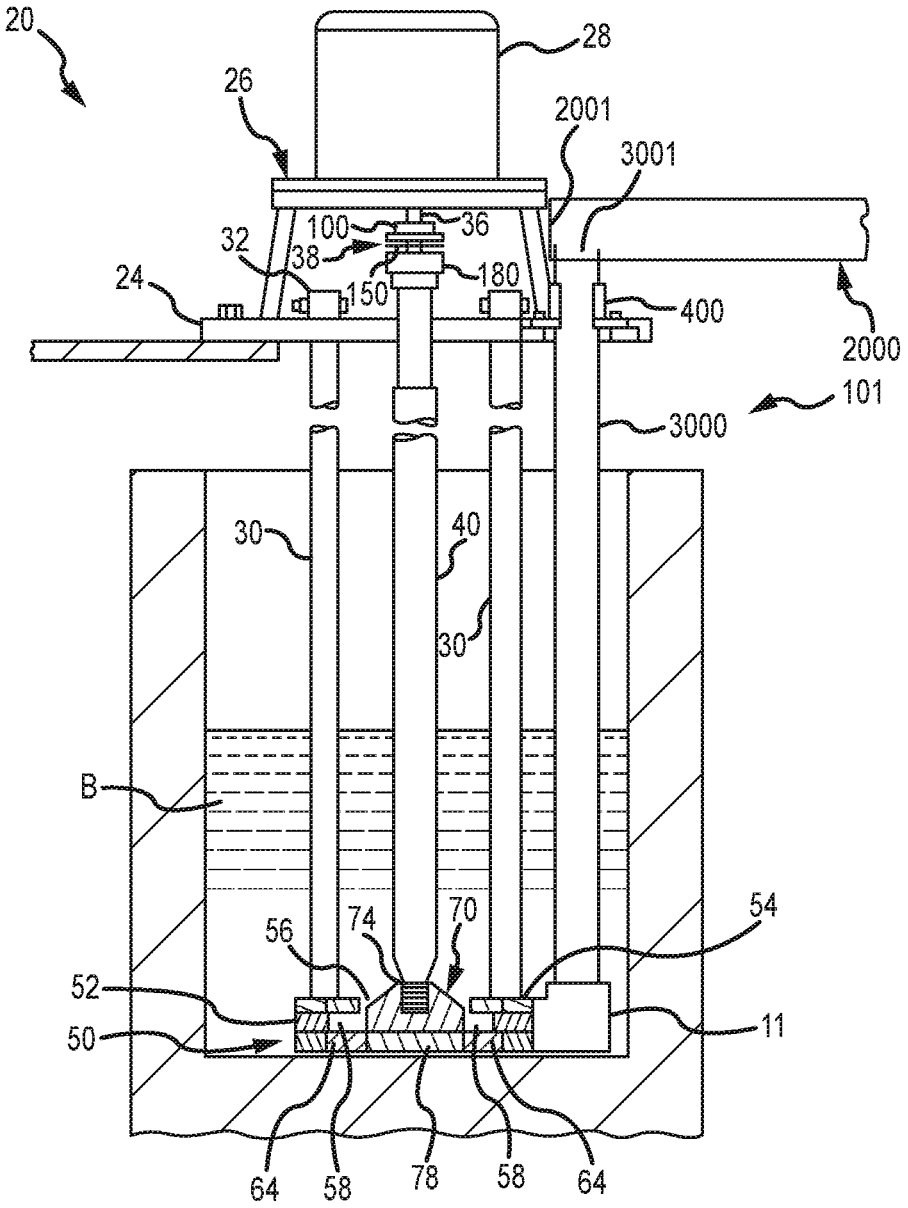
FIG. 4 front, partial cross-sectional view of a transfer pump according to an aspect of the invention.
Figure 5:
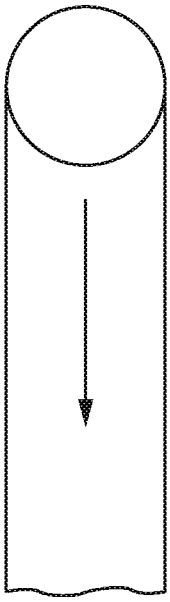
FIG. 5 is a top view of the riser tube/launder configuration shown in FIG. 1, or in FIG. 2 (with the top wall of launder 1000' removed).

FIG. 4 shows a side view of a transfer pump with a riser tube 3000 that terminates at distal end 3001 inside of a launder 2000. In this embodiment, launder 2000 has a closed back end 2001 and molten metal enters the launder and fills it so the molten metal flows in the direction shown by the arrow in FIG. 6.

A launder used in the practice of the invention may be sloped downward, but is preferably horizontal or sloped upward so the flow of molten metal moves back towards the distal end of the riser tube when the pump is turned off and there is no pressure to push molten metal through the launder. A preferred upward slope is 1-10°, or 1-5°, or 1-3°, or an upward slope of ⅛" for every 10' of launder length.

Having thus described some embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired result.

What is claimed:

1. A pump configured to be positioned in a vessel that contains molten metal, the pump comprising:

(a) a pump base having a pump chamber, wherein the pump base comprises a top surface, and an output port;

(b) a riser tube having (i) a passage therethrough, (ii) a proximal end having an opening in communication with the passage, the proximal end being connected to the output port, and (iii) a distal end opposite the proximal end, wherein the distal end has an opening in communication with the passage, the distal end having an opening;

(c) a superstructure above the pump base, the superstructure configured to support the riser tube; and (d) a launder having (i) a first end juxtaposed the riser tube, (ii) an open top, and (iii) a bottom having a launder opening;

wherein the distal end of the riser tube is positioned in the launder opening, and terminates at or above the bottom surface of the launder, and the distal end of the riser tube has a raised portion and a front portion that is lower than the raised portion.

2. The pump of claim 1, wherein the distal end of the riser tube terminates at or above the launder opening.

3. The pump of claim 1, wherein the launder has a raised launder back portion that extends above the launder opening.

4. The pump of claim 3, wherein the raised launder back portion has a height between: being even with the top surface of the launder to being 3" above the top surface of the launder.

5. The pump of claim 1, wherein the raised riser tube back portion has a height between: being even with the top surface of the launder to being 3" above the top surface of the launder.

6. The pump of claim 1 that further includes a motor positioned on the superstructure.

7. The pump of claim 1 that further includes support posts attached to the pump base and to the superstructure.

8. The pump of claim 1 that further includes a drive shaft having a first end connected to a motor, and a second end connected to a rotor, wherein the rotor is positioned in the pump chamber.

9. The pump of claim 8, wherein the drive shaft comprises a rotor shaft with a first end that is received in a coupling, and a motor shaft having an end that is also received in the coupling.

10. The pump of claim 9, wherein the rotor shaft has a second end that is threadingly received in the rotor.

11. The pump of claim 1, wherein the launder has (a) a first portion on a first side of the launder opening, and (b) a second portion on a second side of the launder opening.

12. The pump of claim 1, wherein the distal end of the riser tube terminates within 3" above the bottom of the launder.

13. The pump of claim 1, wherein the pump base further comprises a side surface and the pump outlet is in the side surface.

14. The pump of claim 13, wherein the proximal end of the riser tube is an extension piece formed as an elbow and being configured to direct the flow from the output port upwards.

15. The pump of claim 1, wherein the raised portion is at a height between: being even with the bottom of the launder to being 3" above the bottom of the launder.

16. The pump of claim 1, wherein the launder opening is juxtaposed the first end of the launder.

17. The pump of claim 1 that further comprises a dual-flow rotor.

18. The pump of claim 1, wherein the output port is at the top surface.

* * * * *